US006575852B2

(12) United States Patent
Orner

(10) Patent No.: US 6,575,852 B2
(45) Date of Patent: Jun. 10, 2003

(54) FOOTBALL CENTERING MACHINE

(76) Inventor: Randy Orner, 12220 Harriett Rd., Swanton, OH (US) 43558

( * ) Notice: Subject to any disclaimer, the term of this patent is extended or adjusted under 35 U.S.C. 154(b) by 0 days.

(21) Appl. No.: 10/010,324

(22) Filed: Nov. 8, 2001

(65) Prior Publication Data

US 2002/0082124 A1 Jun. 27, 2002

Related U.S. Application Data

(60) Provisional application No. 60/246,830, filed on Nov. 8, 2000.

(51) Int. Cl.[7] ..... A63B 69/00; A63B 69/32; A63B 63/00; A63B 67/00; F41A 19/00

(52) U.S. Cl. ..... 473/438; 473/439; 473/419; 482/84; 273/359; 124/36

(58) Field of Search ..... 124/7, 8, 21, 36; 473/423, 420, 419, 432, 438–441; D21/720; 273/446, 375; 482/84

(56) References Cited

U.S. PATENT DOCUMENTS 2,109,551 A * 3/1938 Sacher ..... 482/84
2,767,985 A * 10/1956 Maxcey, Jr. et al. ..... 124/36
3,399,892 A * 9/1968 Jurkiewicz ..... 473/438
3,467,380 A * 9/1969 Bonacci ..... 273/359
3,534,958 A * 10/1970 Lipscomb ..... 473/439
3,700,238 A * 10/1972 Mathis ..... 473/438
3,977,386 A 8/1976 Meyer
4,906,001 A 3/1990 Vaughn
5,018,730 A * 5/1991 Iliuta ..... 473/175
6,050,906 A 4/2000 Stout et al.
6,375,584 B1 * 4/2002 Shapiro ..... 473/419

* cited by examiner

*Primary Examiner*—Paul T. Sewell
*Assistant Examiner*—Mitra Aryanpour
(74) *Attorney, Agent, or Firm*—John C. Purdue; David C. Purdue

(57) ABSTRACT

An apparatus for centering a ball is disclosed. The apparatus comprises a base, an upright member supported on the base for pivotal movement with respect to the base, and a pivot arm pivotally supported relative to the upright member for pivotal movement between a first, cocked position and a second, released position. A ball cradle is supported on the pivot arm for releasably supporting a ball to be centered. A bias member urges the pivot arm towards the second, released position and a pivot arm lock is operable, in a first condition, to hold the pivot arm in the first position. The pivot arm lock, in a second condition, releases the pivot arm so that the bias member moves the pivot arm to the released position, thereby centering the ball. The apparatus preferably includes sound actuated means for changing the condition of the pivot arm lock from the first condition to the second condition, to center the ball.

8 Claims, 7 Drawing Sheets

FOOTBALL CENTERING MACHINE

SUMMARY OF THE INVENTION

1. Field of the Invention.

This invention concerns a machine for centering a football and delivering it to the hands of a football player.

2. Background of the Invention

Numerous devices have been invented to centering a football.

U.S. Pat. No. 3,977,386 discloses a football launching apparatus comprising a basket mounted on a spring loaded catapult arm. The apparatus includes a governor for delay the launching of the ball for a pre-determined period of time.

U.S. Pat. No. 4,906,001 discloses what it calls a Football Centering Device comprising a cradle mounted at the end of a spring-loaded, pivotally mounted arm member mounted on a post. A foot latch holds the arm in a cocked position until a player, using his foot, releases the latch by depressing it.

U.S. Pat. No. 6,050,906 ("Stout et al.") discloses what it calls a Mechanical Football Centering Device with a latch for releasing a pivot arm which is actuated by a player's hand. This simulates the practice of riding the center practiced by quarterbacks.

SUMMARY OF THE INVENTION

The instant invention is a machine for delivering a football or other ball to the hands of a person, simulating the centering of a football either directly into the hands of a quarterback or through the air to the hands of a quarterback, a spotter or a punter. The machine preferably includes a microphone and associated circuitry operable to effect delivery of a ball by releasing a pivot arm upon activation of the machine by voice or sound. The machine includes adjustments for varying the speed of the ball upon release and the trajectory of the ball upon release, and adjustments for varying the sensitivity of the voice activated circuitry for releasing the pivot arm to release the ball. The machine can simulate a centered delivery directly into the hands of a player or a centered delivery in which the ball travels through the air to a player as in the case where the ball is to be spotted for a kicker or delivered "shotgun" style to a quarter back. The machine can also be adjusted to deliver a ball to a player at various heights It is an object of the present invention to provide a ball centering machine that is versatile, rugged and easily portable.

It is a further object of this invention to provide a ball centering machine that is sound actuated to release a pivot arm for ball delivery.

It is yet another object of this invention to provide a ball centering machine which can be set to deliver a ball directly into the hands of a ball handler or through the air to the hands of a ball handler, i.e., shot gun style.

These and other objects of the invention will become apparent to those skilled in the art upon considering the following specification.

DETAILED DESCRIPTION OF THE INVENTION

Figure 1:
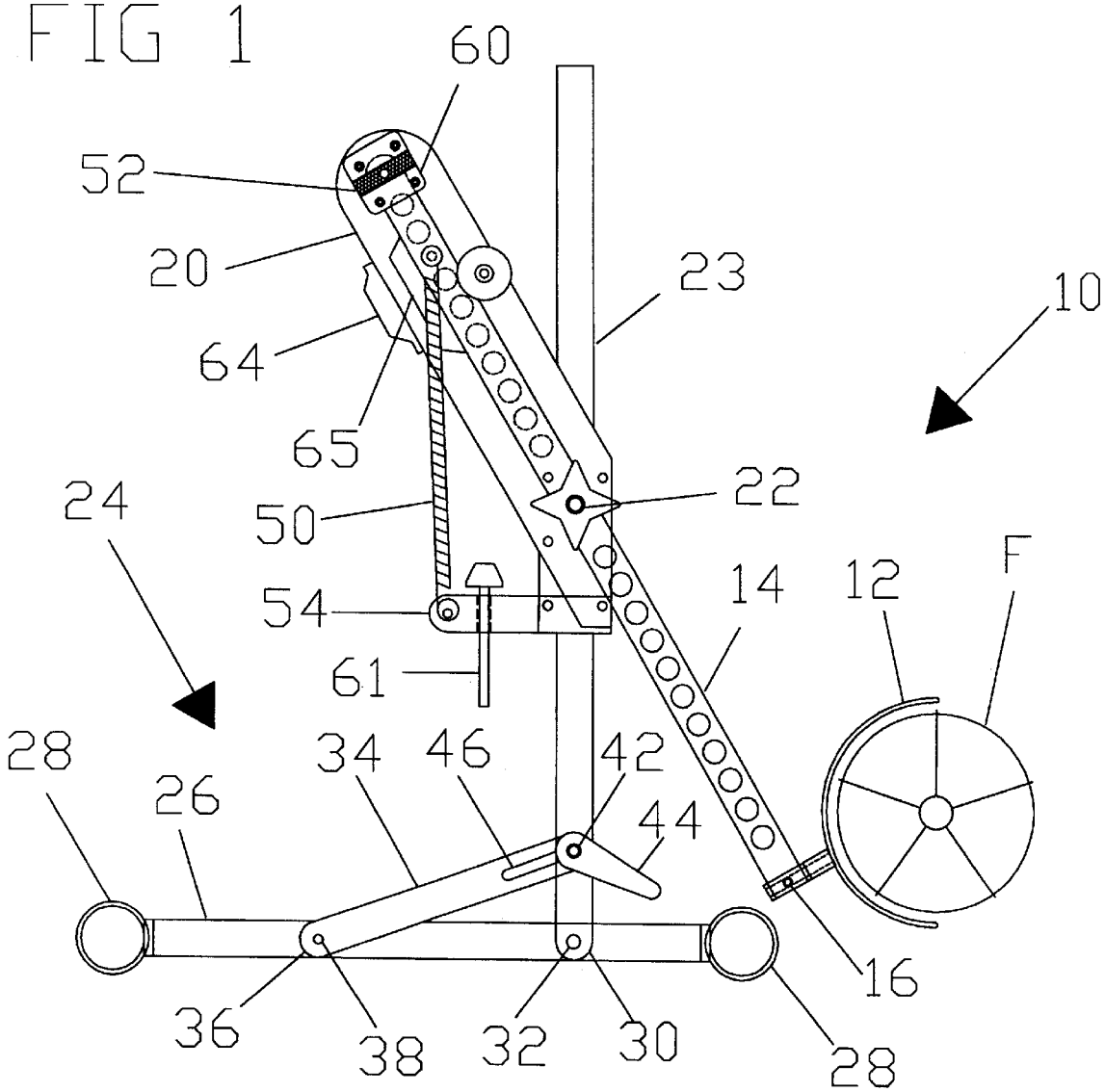
FIG. 1 is a side view showing a ball centering machine according to the present invention, illustrated in a cocked position.
Figure 2:
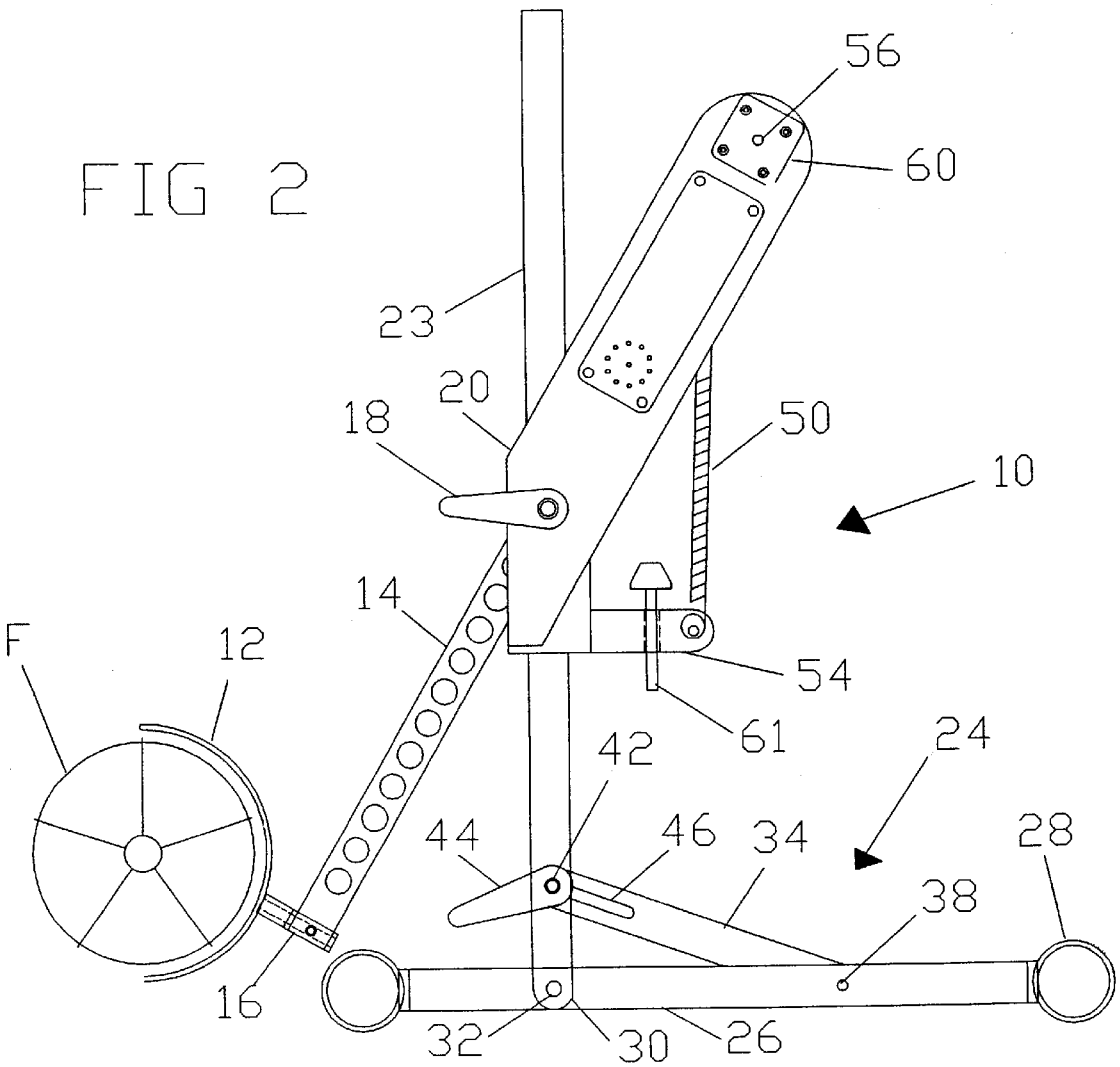
FIG. 2 is a side view showing the opposite side of the ball centering machine illustrated in FIG. 1.

A football centering machine according to the present invention is indicated generally at 10 in FIGS. 1 and 2. The machine comprises a ball cradle 12, which is connected to a first end 13 of a pivot arm 14 by a fastener 16. The ball cradle 12 frictionally engages a football F or other ball, as desired, and holds or retains the ball until the frictional engagement is broken when the pivot arm 14 suddenly stops pivoting.

Figure 3:
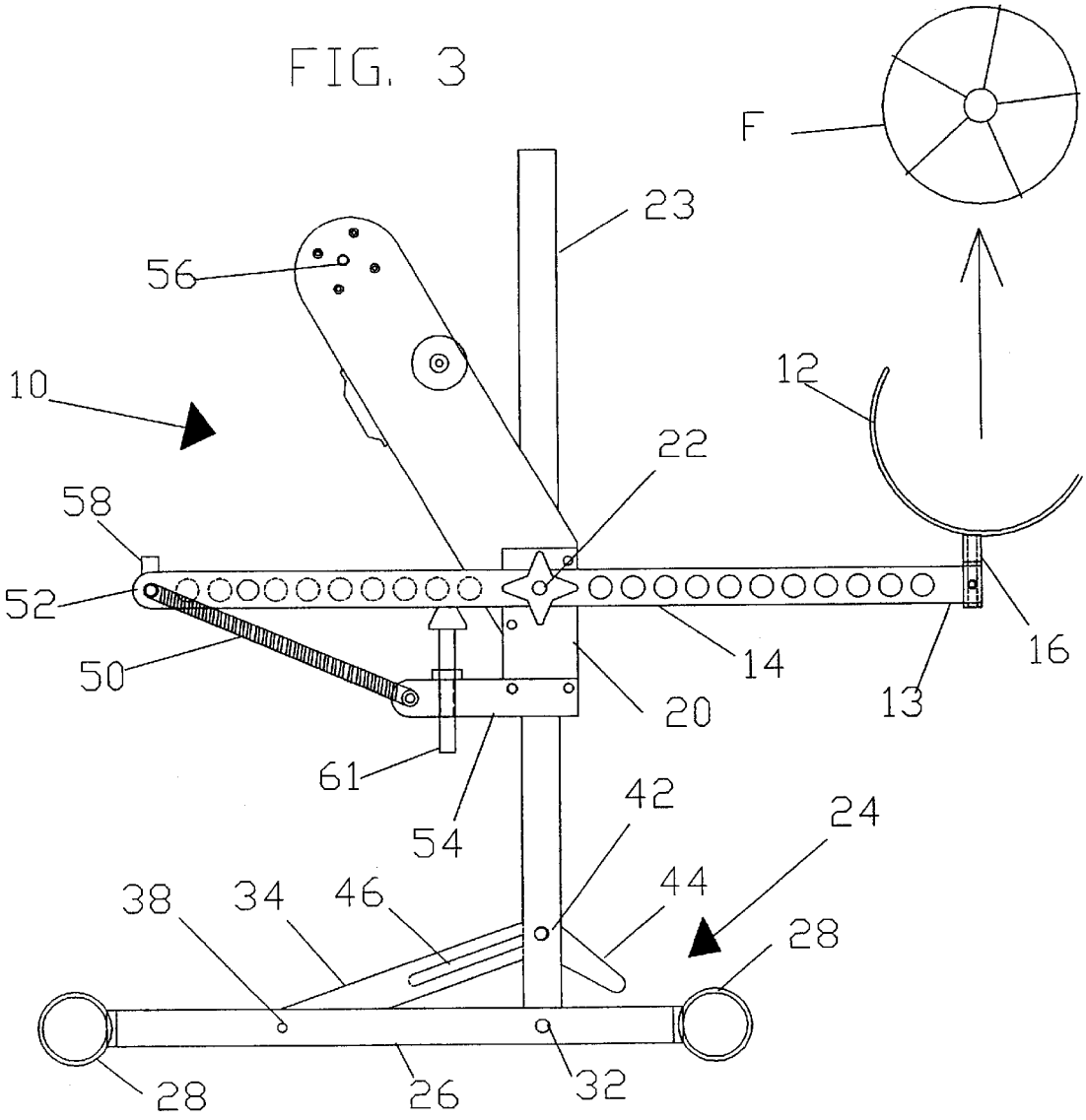
FIG. 3 is a side view of the centering machine corresponding with FIG. 1, after a pivot arm has been released and a ball supported on the arm is leaving the machine.
Figure 4:
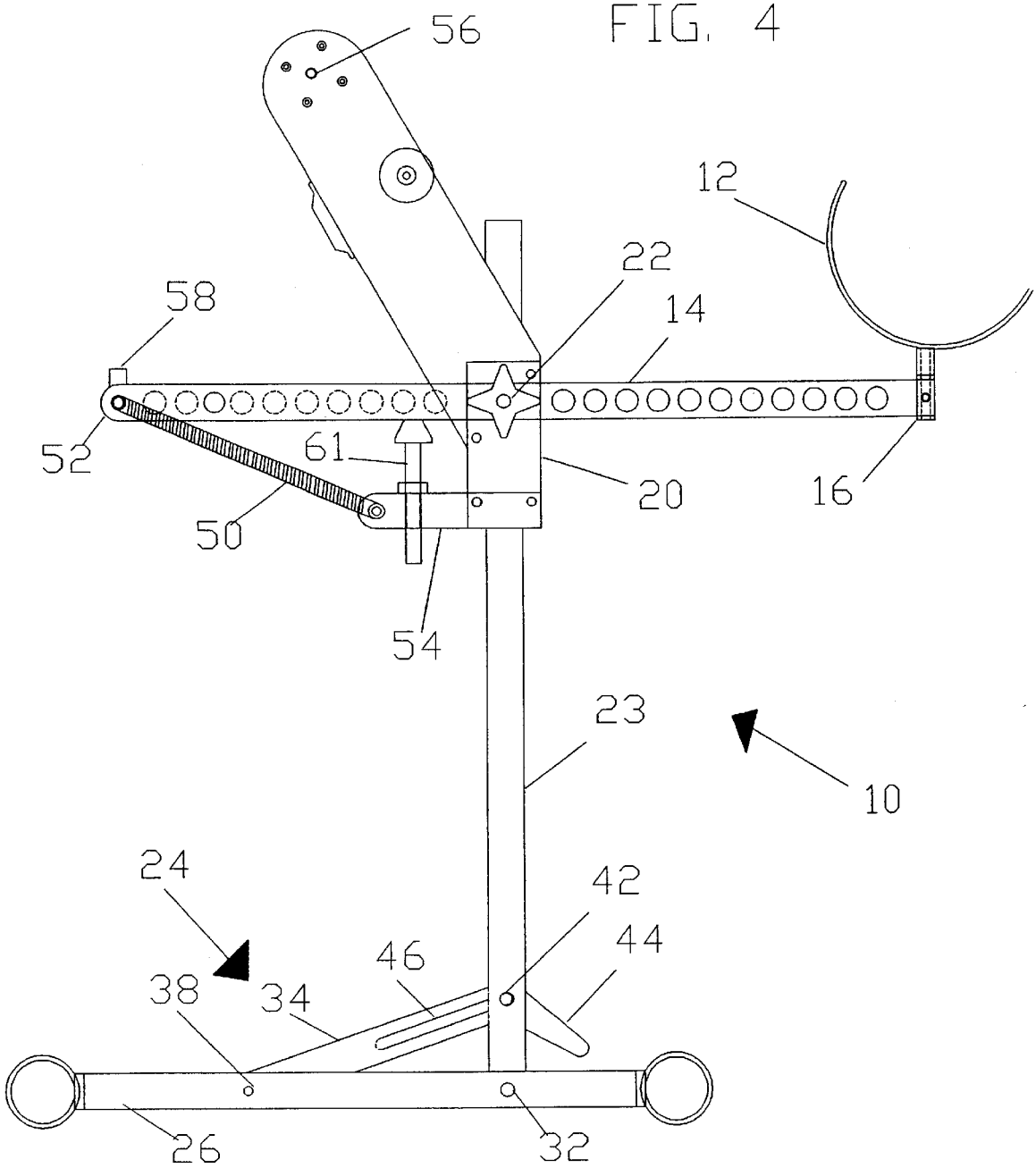
FIG. 4 is a view, similar to FIG. 2, with the pivot arm in a higher position for release of a ball at a higher point.

The pivot arm 14 is mounted on a pivot arm support bracket 20 for pivotal movement, about a pivot connector 22, between a first, cocked position, illustrated in FIGS. 1 and 2, and a release position illustrated in FIG. 3. The pivot arm support bracket 20 is supported on an upright member 23 for sliding movement between a first, lower position shown in FIGS. 1 through 3 and a second, higher position shown in FIG. 4. The pivot arm support bracket 20 can be locked against the upright member 23 with a lock 18 which, in this case, is a threaded device which causes frictional, locking engagement between the upright member 23 and the pivot arm support bracket 20.

The upright member is supported on a base 24. The base 24 comprises a longitudinally extending base member 26 and two laterally extending base members 28 positioned at each end of member 26, with a central portion of each base member 28 being connected to the base member 26, in a generally I-shaped configuration. Other base configurations may be employed, if desired. In a preferred embodiment, the base members 28 serve as battery holders so that the batteries, in turn, serve as ballast to give the machine 10 stability.

Figure 5:
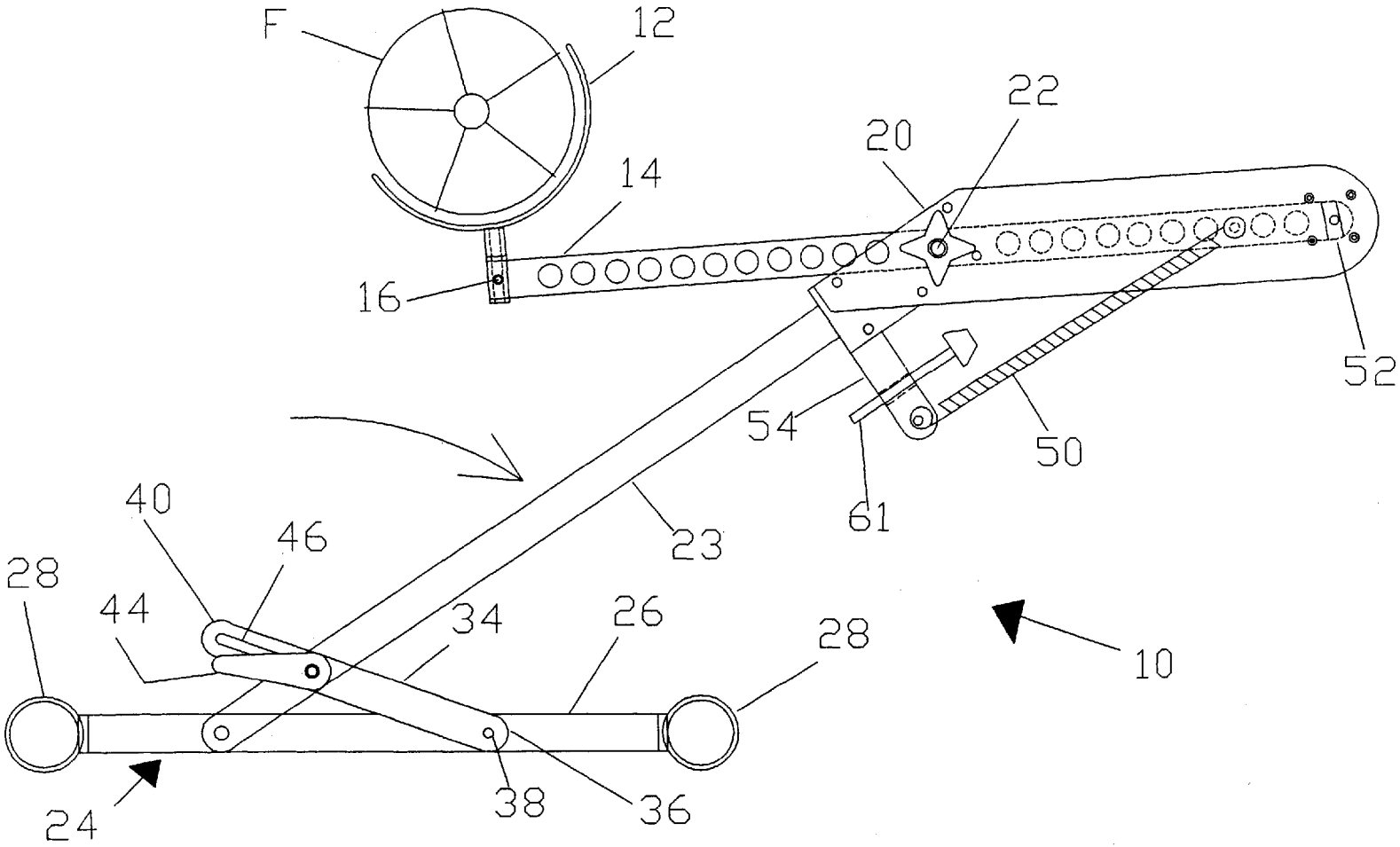
FIG. 5 is a side view, similar to FIGS. 2 and 4, showing an upright that supports the pivot arm in a different orientation for delivering a ball through the air to a player.

A first end 30 of the upright member 23 is pivotally connected to a central portion of the base member 26 by a pivot connector 32. The upright member 23 can be locked to the base in a vertical orientation, as shown in FIGS. 1 through 4, or a non-vertical orientation, as shown in FIG. 5. An upright brace 34 provides a second connection between the base member 26 and the upright 23. A first end 36 of the brace 34 is connected to the base member 26 by a pivot connector 38. A second end 40 of the brace 34 is connected to the upright member 23 by a pivot connector 42, and can be locked to the upright member 23 by a brace and upright lock 44. A slot, indicated at 46, is provided in the second end 40 of the brace 34 so that it can support the upright member 23 in a plurality of orientations including a vertical orientation, as shown in FIGS. 1 through 4, and plurality of non-vertical orientations, such as the one shown in FIG. 5.

Referring now to FIGS. 1 and 3, the pivot arm 14 is shown in a cocked position in FIG. 1 and a released position in FIG.

3. A bias member 50 is connected between a second end 52 of the pivot arm and a bracket 54, which is supported on the pivot arm support bracket 20. The bias member 50 constitutes, in this embodiment, a spring which, unrestrained, biases the pivot arm 14 to pivot from the cocked position, shown in FIG. 1, to the released position shown in FIG. 3. The action of the bias member 50 is restrained by pivot arm lock that comprises a pin 56, which is operable, in a first position, to engage a pin latch 58, which is supported on the second end 52 of the pivot arm 14. The pin 56 moves between the first position and a second position in which it is not operable to restrain the pivot arm 14 from rotating from the cocked position to the released position. Movement of the pin 56 is effected, in this embodiment, by a solenoid, indicated generally at 60. When the pin 56 disengages from the pin latch 58 on the pivot arm 14, the bias member 50 causes the pivot arm 14 to pivot to the released position, shown in FIG. 3, where it engages a stop 61, which is supported on the pivot arm support bracket 20. It is preferred that the stop be supported by threaded, adjustable means so that it can be adjusted to stop the pivot arm 14 from pivoting in a plurality of different orientations, relative to the pivot arm support bracket 20.

Figure 6:
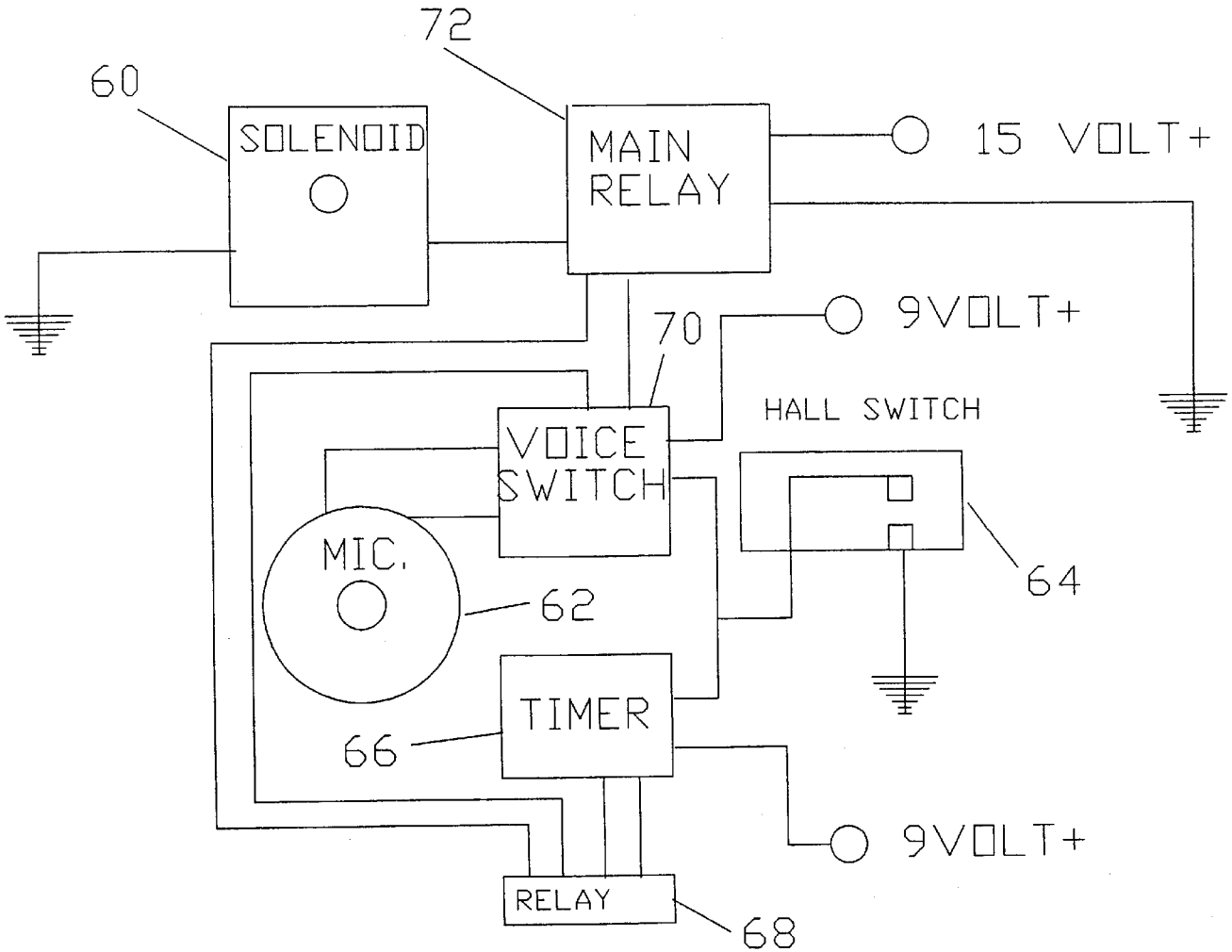
FIG. 6 is a schematic diagram showing components of voice actuation circuitry for moving a pivot arm latch from a first position, in which it is operable to hold the pivot arm in a cocked position, to a second position in which the pivot arm latch is not operable to hold the pivot arm in a cocked position.

It is preferred that the solenoid be sound actuated by circuitry operably associated with the solenoid 60. Suitable circuitry is illustrated schematically in FIG. 6, and includes a microphone 62, a Hall switch or proximity switch 64, a timer 66, a relay 68, a voice switch 70, a main relay 72 for actuating the solenoid 60, voltage sources and wiring connecting the components of the circuitry. The proximity switch 64 is supported on the pivot arm support bracket 20 and a magnet 65 is supported on the pivot arm 14. When the machine is in the released position, shown in FIG. 3, it can be cocked by pivoting the pivot arm 14 to the cocked position shown in FIGS. 1 and 2. This brings the magnet 65 into proximity with the proximity switch 64, thereby closing the proximity switch 64. This actuates the timer circuit 66 which is preset to close the relay 68 after a pre-selected period of time. Six seconds is a good delay. The delay effected by the timer circuit prevents the machine 10 from being actuated by sounds created or caused by cocking the pivot arm 14 and its engagement by the pin 56. When the timer circuit closes the relay 68, the machine is set to be actuated by sound, such as a person saying "HIKE". The sound is picked up by the microphone 62, which causes the voice switch 70 to close the main relay 72. Closure of the main relay 72 actuates the solenoid 60, which withdraws the locking pin 56 from engagement with the pivot latch 58 on the pivot arm 14. As described above, this leaves the pivot arm free to pivot, under the action of the bias member 50, from the cocked positioned shown in FIGS. 1 through 3, to the released position shown in FIG. 4. The pivot arm pivots until it hits the pivot arm stop 61, which suddenly stops the pivot arm 14 from pivoting further. The momentum imparted to the ball F breaks the frictional engagement between the ball F and the ball cradle 12, thereby releasing the ball into the hands of a person, directly or through the air.

Figure 7:
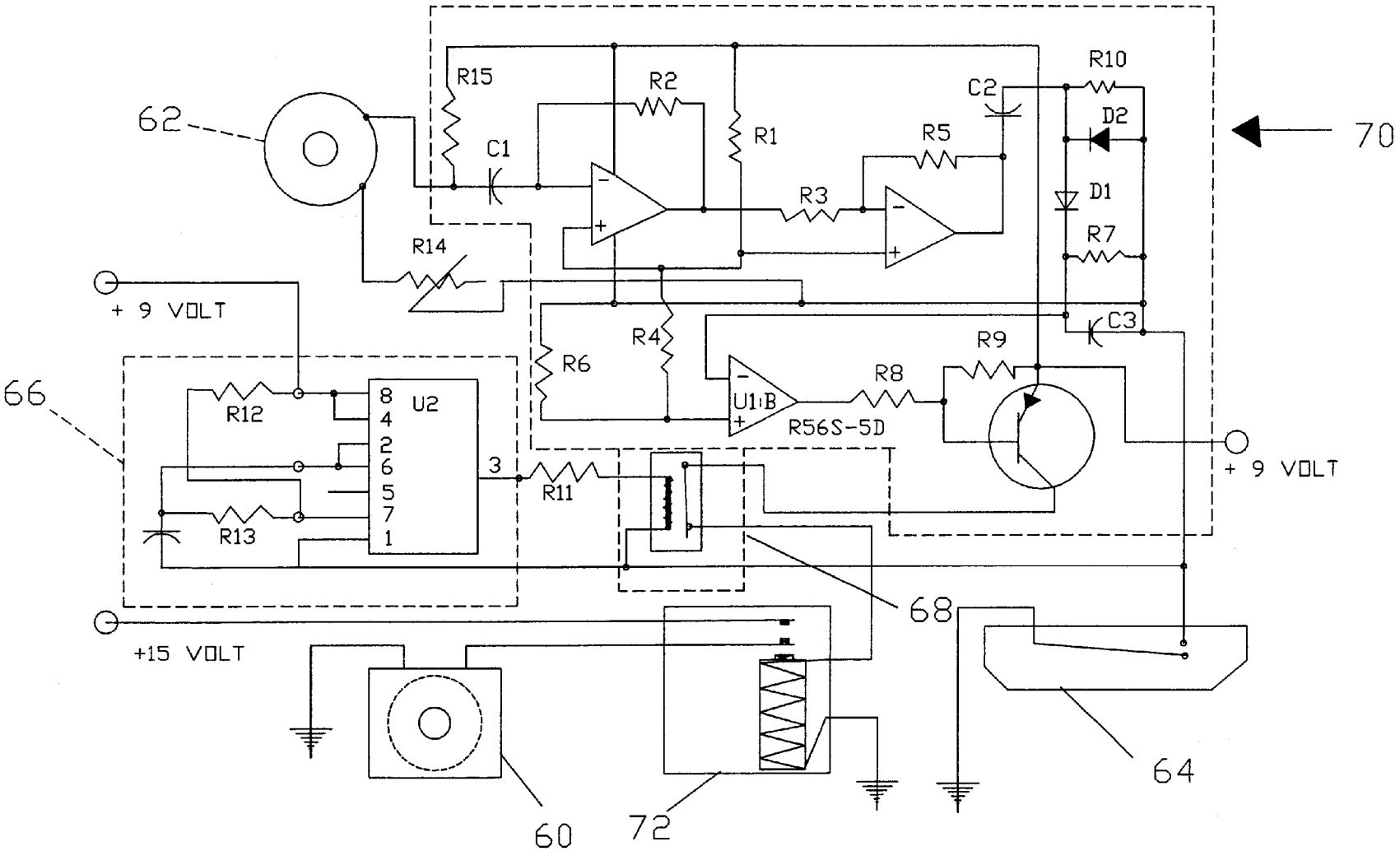
FIG. 7 is a detailed circuit diagram showing details of suitable voice actuation circuitry.

A detailed circuit diagram showing the best mode known for solenoid actuation circuitry is illustrated in FIG. 7, where the indicated elements have the following values and/or identifications:

| ITEM | RESISTORS | ITEM | CAPACITORS |
|---|---|---|---|
| R1 | 10K | C1 | .1 UF |
| R2 | 15 OHM | C2 | 4.7 UF |
| R3 | 3.3K | C3 | 4.7 UF |
| R4 | 6.8K | C4 | 16 V 10 UF |
| R5 | 3.3K | | |
| R6 | 3.3K | | TRANSISTORS |
| R7 | 100K | Q | 2N3906 |
| R8 | 3.3K | | |
| R9 | 1K | | DIODES |
| R10 | 22K | D1, D2 | 1N4148 |
| R11 | 100 OHM | | |
| R12 | 220 OHM | | INTEGRATED CIRCUITS |
| R13 | 10K | U1 | LM324 |
| R14 | 2.2 MEG | U2 | LM555 TIMER |
| R15 | 3.3K | | |

MICROPHONE - 1" DIAMETER CERAMIC
RELAY DIP STYLE R56S-5D,5-6

The foregoing description is provided to enable those skilled in the art to make and use the invention, and to disclose, as required, the best mode known to the inventor for carrying out the invention. The true spirit and scope of the invention, on the other hand, resides in the combinations of elements and functions recited in the following claims.

I claim:

1. An apparatus for centering a ball, said apparatus comprising:

a base an upright member supported on said base, a pivot arm pivotally supported relative to said upright member for pivotal movement between a first, cocked position and a second, released position, a ball cradle supported on said pivot arm for releasably supporting a ball, a bias member operable to urge said pivot arm towards said second position, a pivot arm lock operable in a first condition and inoperable in a second condition to retain said pivot arm in said first position, and sound actuated means for changing the condition of said pivot arm lock from the first condition to the second condition.

2. Apparatus as claimed in claim 1, wherein said pivot arm can be supported on said upright member in a plurality of positions relative to the upright member.

3. Apparatus as claimed in claim 1, wherein said bias member comprises a spring.

4. The apparatus claimed in claim 1, wherein said sound actuated means includes a microphone.

5. The apparatus claimed in claim 4 wherein said sound actuated means includes a timer for delaying the activation of the sound actuated means.

6. The apparatus claimed in claim 1 wherein said pivot arm lock includes a pin and a solenoid actuator for changing the condition of the pivot arm lock.

7. The apparatus claimed in claim 1 wherein said upright member is pivotally connected to said base and wherein said apparatus further comprises connectors for supporting said upright member on said base in a plurality of orientations.

8. An apparatus for centering a ball, said apparatus comprising:

a base an upright member supported on said base for pivotal movement with respect to said base and connectors for supporting said upright member on said base in a plurality of orientations, a pivot arm pivotally supported relative to said upright member for pivotal movement between a first, cocked position and a second, released position, a ball cradle supported on said pivot arm for releasably supporting a ball, a bias member operable to urge said pivot arm towards said second position, a solenoid actuated pivot arm lock supported on said upright member and operable, in a first condition, and inoperable, in a second condition, to retain said pivot arm in said first position, and sound actuated means for changing the condition of said pivot arm lock from the first condition to the second condition.

* * * * *